United States Patent [19]

Gettelfinger

[11] Patent Number: 4,790,538

[45] Date of Patent: Dec. 13, 1988

[54] GOLF PUTTING PRACTICE APPARATUS

[76] Inventor: Irvin C. Gettelfinger, P.O. Box 1407, New Albany, Ind. 47150

[21] Appl. No.: 83,318

[22] Filed: Aug. 10, 1987

[51] Int. Cl.[4] ..... A63B 67/02

[52] U.S. Cl. ..... 273/176 H; 273/176 FA; 273/176 F; 273/195 B

[58] Field of Search ..... 273/176 FA, 176 H, 176 R, 273/176 F, 195 B

[56] References Cited

U.S. PATENT DOCUMENTS 3,595,581 7/1971 Anderson et al. ..... 273/176 H 4,611,809 9/1986 Gettelfinger ..... 273/176 H

*Primary Examiner*—Carroll B. Dority, Jr.

*Attorney, Agent, or Firm*—Jon C. Winger

[57] ABSTRACT

A golf putting practice range apparatus includes a shooting area, a putting surface and a golf ball target area having a target hole at the down-range end of the putting surface. The golfer stands on the shooting area and hits a golf ball over the putting surface in an attempt to sink the golf ball into the target hole. The target hole is adapted to be selectively moved to present different target locations. Further, the putting surface is adapted to provide for selectively changing its contour. The shooting area is adapted to change its inclination with respect to the horizontal and the putting surface. The golf ball target area is also adapted to change its inclination with respect to the horizontal and the putting surface. Thus, the number of combinations and permutations of the inclination of the shootting area, contour of the putting surface, inclination of the target area, and position of the target hole provides for virtually an infinite number of golf putting conditions which can be practices.

20 Claims, 5 Drawing Sheets

GOLF PUTTING PRACTICE APPARATUS

BACKGROUND OF THE INVENTION

The invention relates to golf practice devices, and more particularly to an apparatus for practicing putting.

U.S. Pat. No. 3,831,949 shows a golf putting green made use of a pluralilty of rectangular, planar floor section with alternating ramp sections located between the floor sections. Alternating floor sections are hinged to the intermediate ramp sections. Each floor section includes legs for supporting the putting green. By collapsing selected legs, the floor sections and the ramp sections can be oriented at different inclines relative to each other to provide on undulating path for the golf ball. The golf putting green also includes ball deflecting bars which are adjustable to provide obstacles to the golf ball. The position of the deflecting bars is adjustable. A number of golf ball holes are positioned at one end of the putting green. Plugs are removably inserted in selected golf ball holes to allow for changing the location of the one golf ball hole being used as the target.

U.S Pat. No. 2,871,661 shows a golf putting green made of a flat support base covered by a layer of artificial turf. An undilating surface is provided by bodies which are blocks of wood having curved top surfaces. The bodies are located between the base and artificial turf. The bodies have handles projecting beyond the outer edge of the putting green by which the position of the bodies can be changed. Further, the bodies each have cups into which the ball is to be putted. Selected cups can be covered by plugs to change locations of the target cup.

U.S. Pat. No. 3,892,412 shows a golf putting green formed of a plurality of pads laid end-to-end. The pads can be stacked for storage. Each pad is formed of a base having a top sheet of artificial turf with a plurality of inflatable bags located under the top sheet. The bags are inflated through tubes which extend to the edge of the pad. The pads each include a cup which can be closed by a cover to change locations of the target hole.

U.S Pat. No. 4,114,887 shows a golf putting green made of a flexible grid layer covered by a fabric layer. The flexible grid layer is made of clip-like grid elements interconnecting transversely extending cross bars. Screw jacks are attached to the flexible grid layer along the longitudinal edges of the grid layer. In addition, a link is pivotally connected to the transverse cross bars and is driven for pivotable motion by a double acting cylinder. As the link is rotated, it bend the transverse cross bar to which it is attached. Thus, by activating the jacks, the longitudinal contour of the putting green is changed, and by activating the cylinder the transverse contour of the putting green is changed.

U.S. Pat. No. 4,211,417 shows a golf putting green formed of a plurality of planar member of, for example ¾" thick plywood, fastened together at their abutting edges by fasteners of, for example steel bands ¼ thick. A layer of artificial turf overlays the planar members. Lifting devices are located at the intersection of four of the planar members. The lifting devices include a ramp attached to the underside of the planar members at the intersection thereof, and a movable wedge. The wedge is moved toward and away from the ramp by means of a rod which extends outwardly past the periphery edge of the putting green. As the wedge is moved against the ramp it lifts the portions of the planar members to which the ramp is attached, thus, creating a contourable putting surface. At least one of the planar members is provided with a cup into which a golf ball is to be putted. The periphery of the putting green is fastened to the base against movement so that the planar members will be distorted upon actuation of the lifting device.

U.S. Pat. No. 4,222,568 illustrates a golf putting green having a flat reinforced section upon which the player stands to putt the golf ball and a bendable section extending from the reinforced section. A hole is formed in the bendable section at the far end thereof from the reinforced section. A ball return chute extends from the hole to a location below the reinforced area. Cross members extend across the putting green under the bendable section and are attached at their opposite ends to the frame. Screw jacks are mounted in the cross members and abut the underside of the bendable section. When the screw jacks are turned they raise or lower local areas of the bendable section creating contours. A rack and pinion arrangement can be substituted for the screw jacks. The pinions are turned by means of a shaft which extends outwardly of the edge of the putting green.

U.S. Pat. No. 4,240,637 shows a golf putting green having a putting surface covered with a sheet of fabric. The putting surface is a single sheet of plywood. The plywood surface is supported by height adjustment devices. These height adjustment devices each comprise bolts which extend through captive nuts attached to the plywood surface and engages a nut affixed to the frame. As the bolts are turned by means of handles, they co-act the captive nuts to raise and lower portions of the plywood surface altering the curvature and/or slope of the putting surface. A hole is formed through the putting surface at one end thereof. Ball return channels are located below the putting surface for returnign balls to the opposite end of the putting green.

U.S. Pat. No. 4,611,809 shows a golf putting practice apparatus which has a fixed position shooting area, a fixed position target area with a movable target hole, and a contourable putting surface comprised of interconnected planar sections. The position of the planar sections are changed relative to the horizontal to change the contour of the golf putting surface.

SUMMARY OF THE INVENTION

It is an object of the invention to provide a golf ball putting apparatus which includes a golf ball shooting area is movable to change its inclination relative to the golf ball putting surface.

Another object of the invention is to provide a golf ball putting apparatus which includes a golf ball target area which is movable to change its inclination relative to the golf ball putting surface.

A further object of the invention is to provide a golf ball putting apparatus which includes a novel contourable putting surface.

More particularly, the present invention, in one embodiment, provides a golf ball putting practice apparatus comprising a shooting area upon which a golfer stands when putting a golf ball; a putting surface immediately downrange of the shooting area across which the golfer hits the golf ball; means for changing the inclination of the putting surface; and, a golf ball target area formed with at least one golf ball target hole at the downrange end of the putting surface.

In another embodiment, the present invention provides a golf ball putting practice apparatus comprising a shooting area upon which a golfer stands when putting the golf ball; a putting surface immediately downrange of the shooting area across which the golfer hits the golf ball; a golf ball target area formed with at least one golf ball target hole at the downrange end of the putting surface; and means for changing the inclination of the golf ball target area.

In still another embodiment, the present invention provides a golf ball practice apparatus comprising a shooting area upon which a golfer stands when putting the golf ball; means for changing the inclination of the shooting area; a putting surface immediately downrange of the shooting area across which the golfer hits the golf ball; and a golf ball target area formed with at least one golf ball target hole at the downrange end of the putting surface.

In yet another embodiment, the present invention provides a golf ball putting practice apparatus having a selectively contourable putting surface comprising a plurality of parallel spaced apart flexible and elastic rod members extending the entire length of the putting surface; and means for selectively bending the rod members along the length thereof.

BRIEF DESCRIPTION OF THE DRAWINGS

The various features and advantages of the putting apparatus of the present invention are presented in detail in the following description and accompanying drawings wherein.

DETAILED DESCRIPTION OF THE PREFERRED EMBODIMENT

Figure 1:
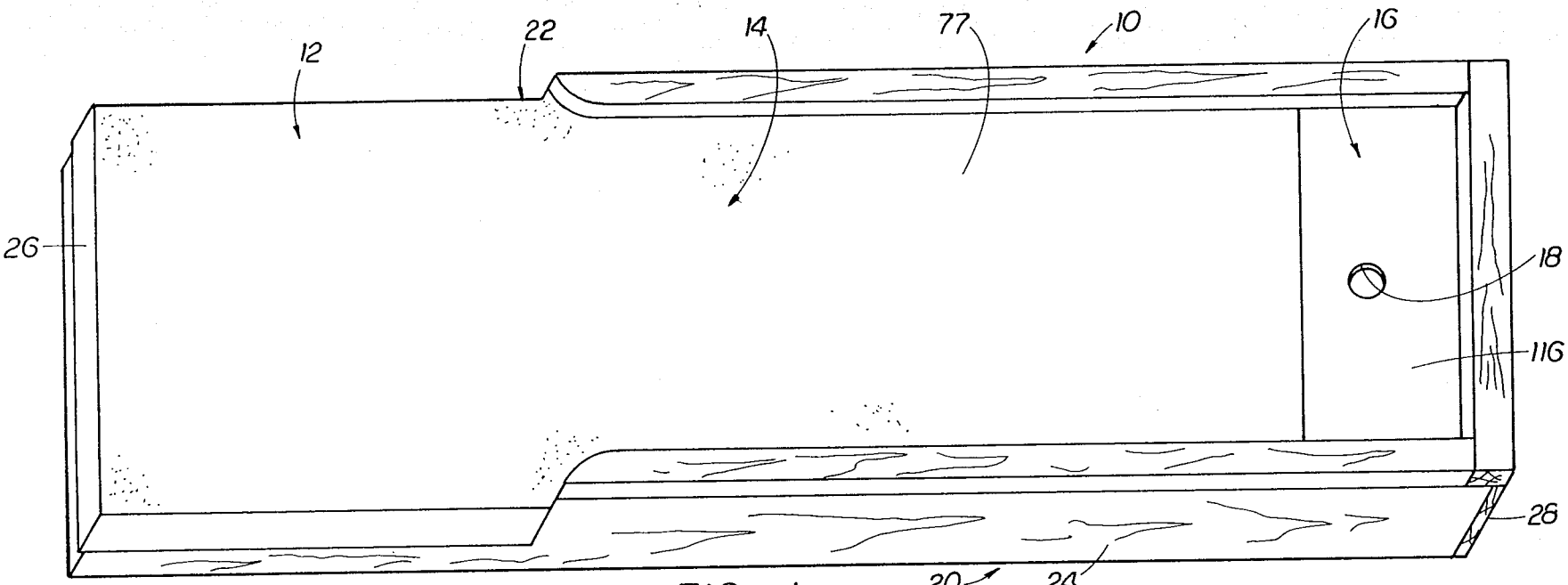
FIG. 1 is a perspective view of the golf putting apparatus of the present invention.

FIG. 1 illustrates the golf ball practice apparatus, generally denoted as the number 10, of the present invention. The golf putting practice apparatus is illustrated a comprising three subdivisions: a shooting subdivision 12 at the uprange end of the apparatus 10 upon which the golfer putting a golf ball stands; a contourable putting subdivision 14 immediately downrange of the shooting subdivision 12 over which the golf ball is rolled; and a target subdivision 16 immediately downrange of the contourable putting subdivision 14 having a golf ball target receiving hole 18 into which the golfer attempts to sink the golf ball.

Figure 2:
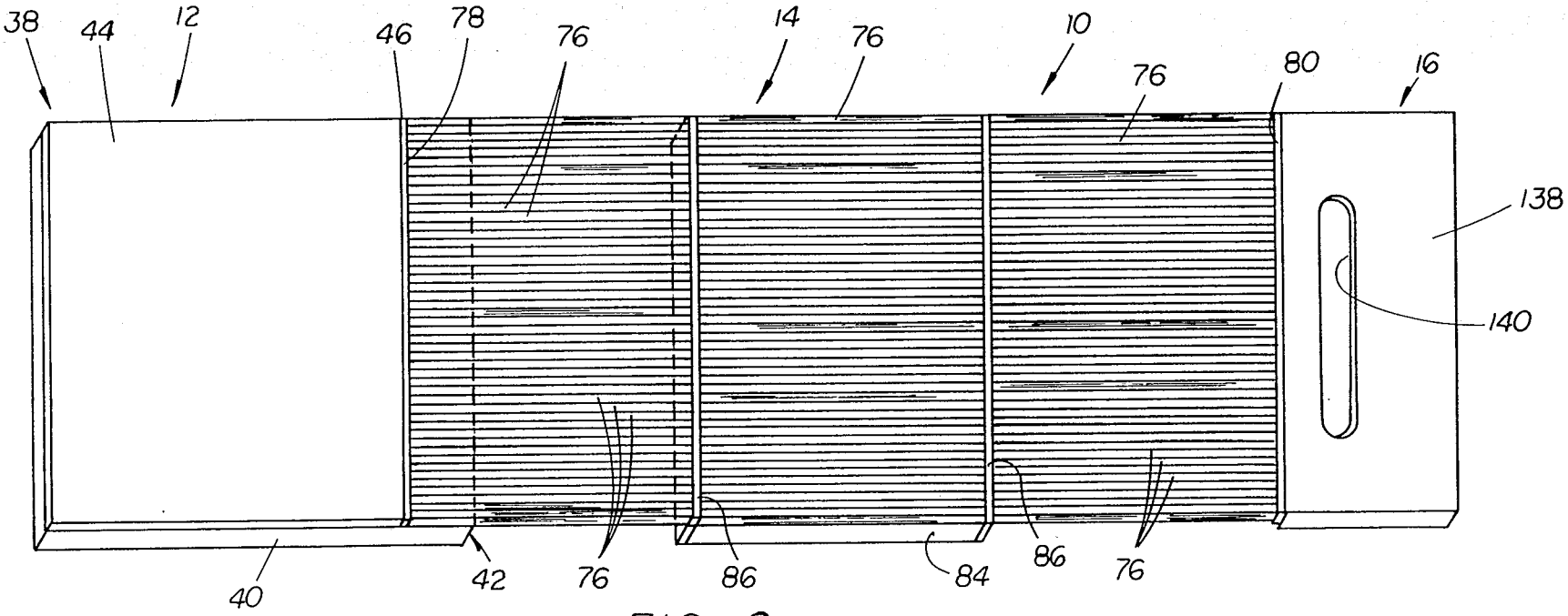
FIG. 2 is a perspective view of the apparatus of FIG. 1 with the covering removed to show the contourable putting surface, inclinable golf ball shooting area, and inclinable and movable golf ball target area.

With continued reference to FIGS. 1 and 2, the golf putting apparatus 10 includes a frame structure, generally denoted as the numeral 20, comprising two, parallel, spaced apart side walls 22, 24, and two parallel, spaced apart end wall 26, 28 interconnecting the opposite ends of the side walls 22, 24, and a floor 30.

Now with reference to FIGS. 2, 3, 4, 5, 6, and 8, the shooting subdivision 12 comprises a base 32 affixed to the floor 30 of the frame structure 20. The base 32 includes two parallel, spaced apart rails 34 affixed to the floor 30 at opposite longitudinal sides of the floor 30 and extending longitudinally of the floor 30. The top surface 36 of the rails 34 are at an acute angle to the horizontal, and therefore, to the plane of the floor 30 inclined in a direction from the frame end wall 26 at the uprange end of the apparatus 10 toward the opposite end wall 28 at the downrange end of the apparatus 10. The elevated ends of the rails 34 of the base 32 are located proximate the interface of the shooting subdivision 12 and contourable putting subdivision 14. The shooting subdivision 12 further includes a selectively inclinable floor 38 attached to the base 32 for pivotal movement about an axis transverse to the longitudinal axis of the putting subdivision 16. The floor 38 includes two, parallel, spaced apart braces 40 located over and coextensive with the top surfaces 36 of the rails 34 of the base 32, and pivotally attached to the rails 34 at the elevated ends thereof by means of hinges 42. The floor 38 further includes a planar panel 44 overlaying the braces 40 and attached thereto. The panel 44 extends from the free ends of the braces 40 toward the hinged ends thereof, but terminates at a transverse edge 46 a distance short of the hinged ends of the braces 40. The floor 38 is, thusly, inclinable at various angles to the horizontal about the transverse hinges 42.

Figure 8:
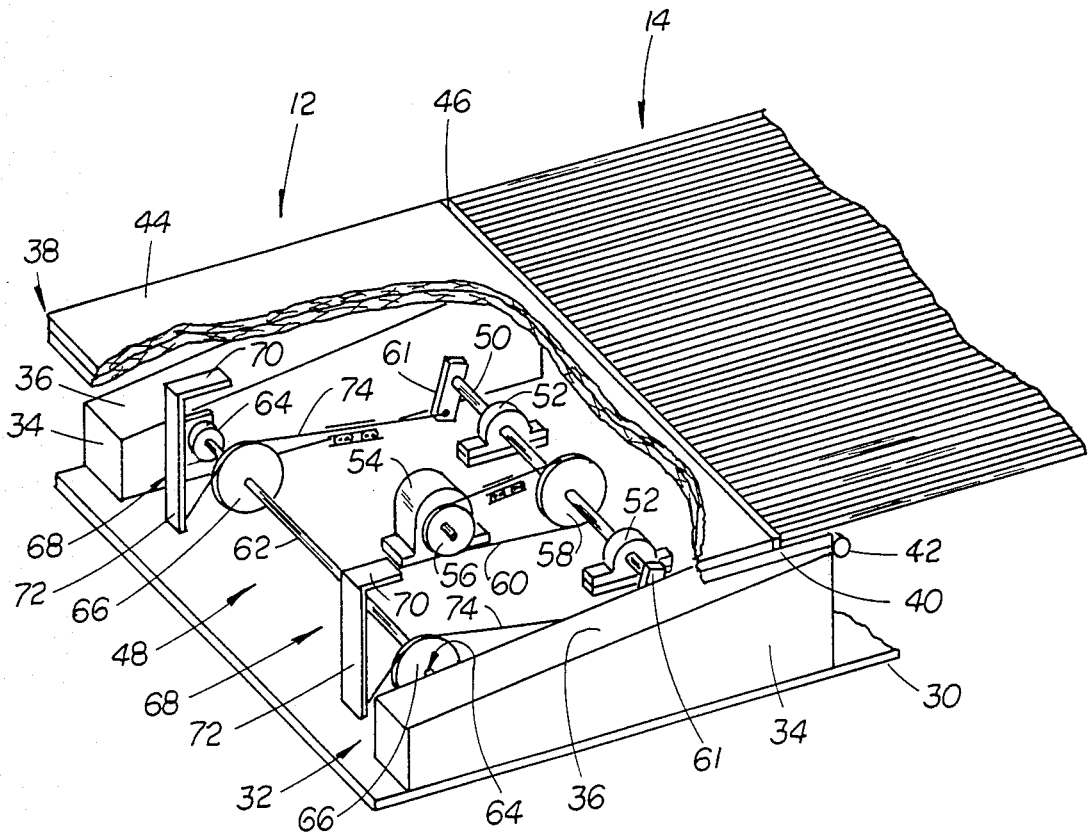
FIG. 8 is a perspective view, with portions broken away, showing details of the golf ball shooting area.

With references to FIG. 8, the shooting subdivision 12 further includes jack means, generally as the numeral 48, for selectively moving the shooting subdivision inclinable floor 38 about the hinges 42. As shown, the jack means 48 is located beneath the shooting subdivision floor 38 and comprises a drive axle shaft 50 anchored to the frame structure floor 30 by journals 52. A drive motor 54 is located next to the drive axle shaft 50 with its output shaft generally parallel to the drive axle shaft 50. A drive sprocket 56 is affixed to the motor output shaft and a driven sprocket 58 is affixed to the drive axle shaft 50. An endless drive chain 60 is trained about the drive sprocket 56 and driven sprocket 58 such that rotation of the motor drive shaft causes the drive axle shaft 50 to rotate in the same direction therewith. A crank arm 61 is attached to each end of the drive axle shaft 50. A driven axle jack shaft 62 is located in spaced apart parallel relationship to the drive axle shaft 50. The driven axle shaft 62 is anchored at its opposite ends in journals 64 attached to the opposite rails 34 of the shooting subdivision base 32. Driven chain sprockets 66 are affixed to the driven axle jack shaft 62. A pair of spaced apart angle brackets 68 are affixed to the driven axle jack shaft 62 for rotation therewith. One leg 70 of the angle brackets 68 are oriented to overlay and abut the underside of the shooting subdivision floor 38. The other leg 72 of the angle brackets depend from the driven axle jack shaft 62. Drive chains 74 interconnect the depending leg 72 of each angle bracket 68 to a different one of the crank arms 61. One end of each drive chain 74 is attached to the free end of one of the crank arms 61, is trained partially about one of the driven chain sprockets 66, and has its other end attached to the free end of the depending leg 72 of one of the angle brackets 68. When the drive motor 54 is actuated to turn its output shaft; in for example counter-clockwise as seen in FIG. 8, the drive axle shaft 50 is caused to also rotate counter-clockwise causing the crank arms 61 to move through a bottom 180 degree arc in a direction away from the driven axle jack shaft 62. This movement causes the crank arms 61 to pull the drive chains 74 and in turn causes the angle brackets 68 to rotate counter-clockwise with the driven axle jack shaft 62, thus, moving the leg 70 of the angle brackets 68 upwardly and pushing against the shooting subdivision floor 30. This causes the shooting subdivision floor 30 to pivot about the hinges 42 in a clockwise direction such that the floor 30 assume a declined position toward and relative to the contourable putting subdivision 14. As the drive motor 54 continues to turn the motor output shaft in the counter-clockwise direction, the drive axle shaft 50 also continues to rotate counter-clockwise causing the crank arms 61 to move through a top 180 degree arc in a direction toward the driven jack shaft 62. This movement of the crank arms 61 gradually releases the pulling tension on the drive chain 74. The weight of the inclinable shooting subdivision floor 38 pushes downwardly on the legs 70 of angle brackets 68 allowing the inclinable shooting subdivision floor to gradually pivot in a counter-clockwise direction about the hinges 42 against the decreasing tension on the drive chain 74, as dictated by releasing tension on the drive chain 74, until the inclinable floor 38 contacts the top surfaces 36 of the rails 34 of the base 12 at which time the inclinable floor 38 is at the full inclined position toward and relative to the contourable putting subdivision 14. Of course, the movement of the inclinable floor 38 can be stopped as it is moved in either direction about the hinges 42 by merely stopping the motor 54. Thus, the inclinable floor 38 can be selectively positioned coplanar with the contourable putting subdivision 14, inclined at various angles to the contourable putting subdivision 14, or declined at various angles to the contourable putting subdivision 14.

Figure 3:
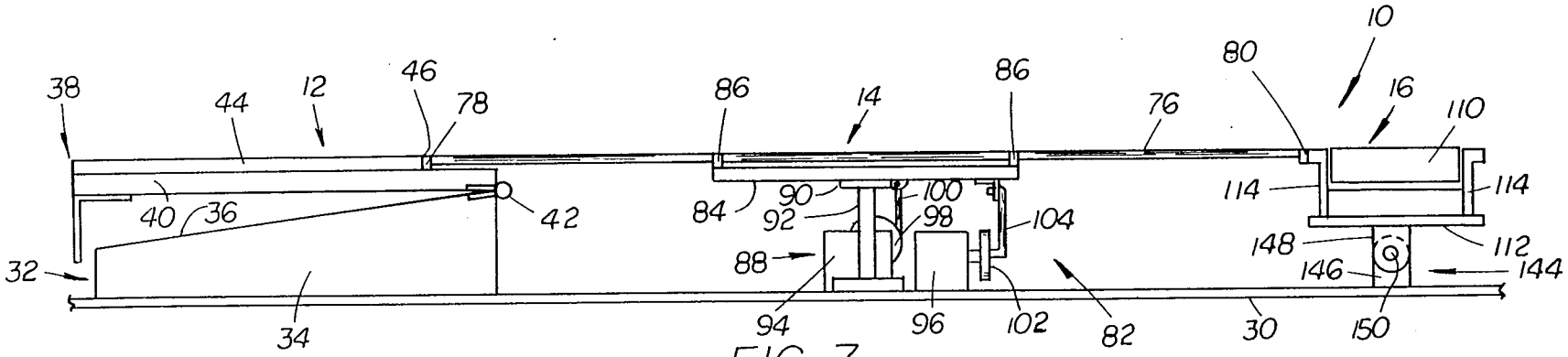
FIG. 3 is a longitudinal cross-sectional view of the apparatus of FIG. 3 illustrating one obtainable position of the golf ball shooting area, contourable putting surface, and golf ball target area.
Figure 4:
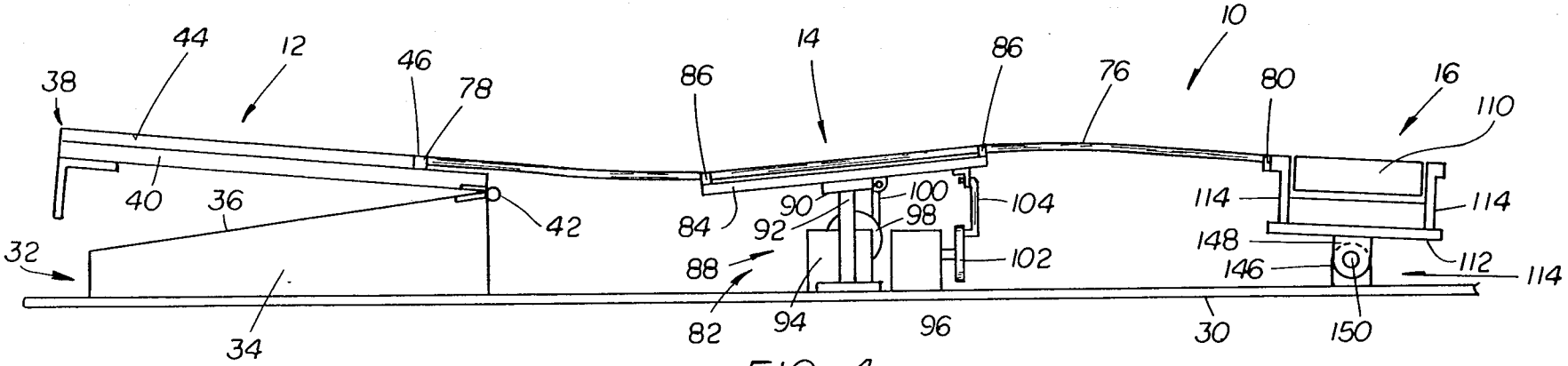
FIG. 4 is a longitudinal cross-sectional view of the apparatus of FIG. 2 illustrating another obtainable position of the inclinable golf ball shooting area, contourable putting surface, and inclinable and movable golf ball target area.
Figure 5:
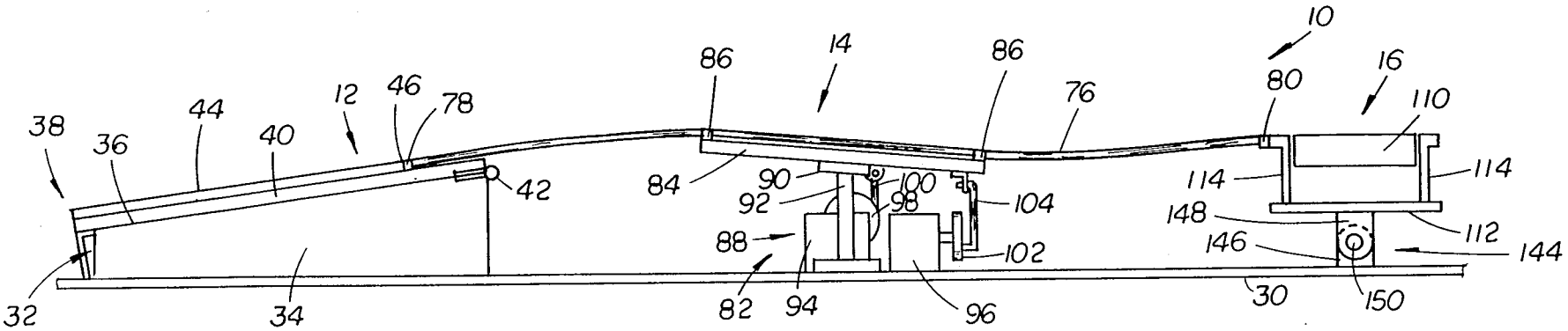
FIG. 5 is a longitudinal cross-sectional view of the apparatus of FIG. 2 illustrating yet another obtainable position of the golf ball shooting area, contourable putting surface, and golf ball target area.

Now with reference to FIGS. 2, 3, 4, 5, 6 and 7, the contourable putting subdivision 14 comprises a plurality of parallel, closely spaced apart flexible and resilient rods 76 extending longitudinally of the golf putting practice apparatus 10 from the shooting subdivision 14 to the target subdivision 16. The rods 76 can be formed of virtually any type of flexible and resilient material such as, for example, plastic tubing, plastic pipe, fiberglass, high tensil steel and some types of wood. Each of the rods 76 is attached at its uprange end to the shooting subdivision 12 and at its downrange end to the golf ball target subdivision 16. As shown in FIGS. 3, 4 and 5, the uprange ends of the rods 76 are received in appropriate apertures in an anchor plate 78 transversely extending across and attached to the downrange side of the shooting subdivision 12 and more particularly the transverse edge 46 of the panel 44, and the downrange ends of the rods 76 are received in appropriate apertures in an anchor plate 80 transversely extending across and attached to the uprange side of the target subdivision 16. The rods 76 are covered with a fabric covering 77 of virtually any type, for example outdoor carpeting, artificial grass and the like. The covering 77 also extends over the top surface of the floor 38 of the shooting subdivision 12. The contourable putting subdivision 14 further comprises means, generally denoted as the numeral 82, for changing the contour of the putting surface of the putting subdivision 14. The contour changing means 82 is located beneath the rods 76 approximately mid-way between the shooting subdivision 12 and target subdivision 16. The contourable changing means 82 comprises rod bending means such as a movable plate 84 situated immediately beneath the rods 76 and extending transversely across the array of rods 76. Each of the rods 76 are attached to the movable plate 84 by, for example, being received through appropriate apertures in anchor plates 86 transversely extending across and attached to the movable plate 84. The movable plate 84 is supported above the apparatus floor 30 by, for example, bearing support means 88, extending between the underside of the movable plate 84 and apparatus floor 30. The bearing support means 88 is shown as including a self-aligning swivel bearing 90 attached to the underside of the movable plate 84 at the geometric center thereof, and a vertical bearing support post 92 affixed at its bottom end to the apparatus floor 30 and at its top end to the self-aligning bearing 90. Thus, the movable plate 84 can be moved about the bearing 90 about the longitudinal axis of the putting subdivision 14 and about the transverse axis of the putting surface of the putting subdivision 14.

As shown, the contour changing means 82 also includes a first motor 94 operatively associated with the movable plate 84 to tilt or move the movable plate 84 about the longitudinal axis of the putting surface of the putting subdivision 14 to change the left to right or lateral slope and grade of the putting surface, and a second motor 96 operatively associated with the movable plate 84 to tilt the movable plate 84 about the transverse axis of the putting surface of the putting subdivision 14 to change the longitudinal slope and grade of the putting surface. As shown, the first motor 94 includes a cam 98 attached to its output shaft. The cam 98 is operatively associated with the movable plate 84 by a follower arm 100 connected to the underside of the movable plate 84 to one side of the longitudinal axis of the putting surface. Thus, as the motor 94 is actuated, the cam 98 rotates with the motor output shaft and the movable plate 84 is caused to tilt about the self-aligning bearing 90 by the follower arm 100 as dictated by the development of the cam 98. Similarly, the second motor 96 includes a cam 102 attached to its output shaft. The cam 102 is operatively associated with the movable plate 84 by a follower arm 104 connected to the underside of the movable plate 84 to one side of the transverse axis of the putting surface. Thus, as the second motor 96 is actuated, the cam 102 rotates with the motor output shaft and the movable plate 82 is caused to tilt about the self-aligning bearing 90 by the cam follower arm 104 as dictated by the development of the cam 102.

FIGS. 4 and 5 illustrate the movable plate 84 tilted about the transverse axis of the putting surface of the putting subdivision 14. In FIG. 4, the movable plate 84 is tilted to an inclined position which forces the portion of the rods 76 near the elevated downrange end of the movable plate 84 upwardly causing them to form a convex arc between the movable plate 84 and target subdivision 16, and forces the portion of the rods 76 near the lowered uprange end of the movable plate 84 downwardly causing them to form a concave arc between the shooting subdivision 12 and movable plate 84. In FIG. 5, the movable plate 84 is tilted to a declined position which forces the portion of the rods 76 near the lowered downrange end of the movable plate 84 downwardly causing them to form a concave arc between the movable plate 84 and target subdivision 16, forces the portion of the rods 76 near the elevated uprange end of the movable plate 84 upwardly causing them to form a convex arc between the shooting subdivision 12 and movable plate 84. Thus, the longitudinal contour of the putting surface of the putting subdivision can be virtually infinitely changed.

Figure 6:
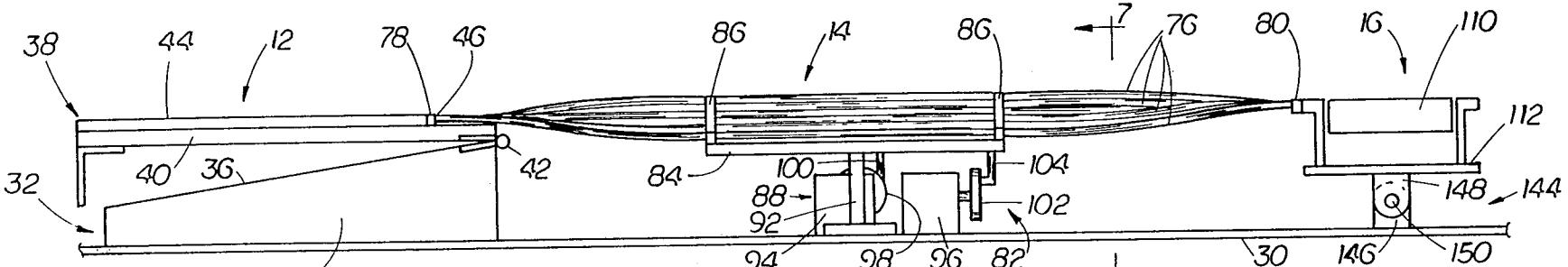
FIG. 6 is a longitudinal cross-sectional view of the apparatus of FIG. 2 illustrating still another obtainable position of the golf ball shooting area, contourable putting area, and golf ball target area.
Figure 7:
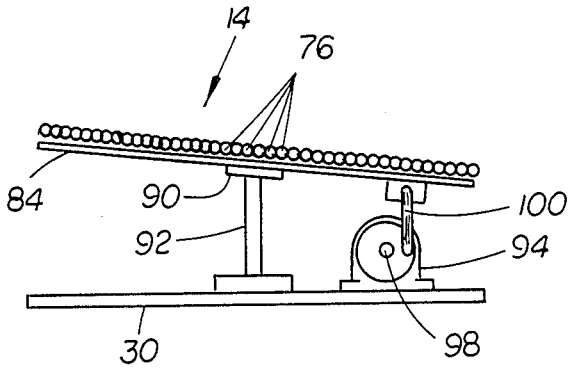
FIG. 7 is a transverse cross-sectional view as seen in the direction of arrows 7—7 in FIG. 6.

FIGS. 6 and 7 illustrate the movable plate 84 tilted about the longitudinal axis of the putting surface of the putting subdivision 14, such that one lateral side of the plate 84 is elevated and other lateral side of the plate 84 is lowered. The raised or elevated side of the movable plate 84 forces the portion of the rods 76 near the elevated lateral side upwardly causing them to form a convex arc from the shooting subdivision 12 to the target subdivision 16. The lowered side of the movable plate 84 forces the portion of the rods 76 near the elevated lateral side downwardly causing them to form a concave arc from the shooting subdivision 12 to the target subdivision 16. The rods 76 between the elevated most one of the rods at the elevated lateral side of the movable plate 84 and the lower most one of the rods at the lowered lateral side of the movable plate 84 bend to different degrees. Thus, the lateral contour of putting surface of the putting subdivision can be virtually infinitely changed.

It should be clearly understood that the movable plate 84 can be tilted about the longitudinal axis and transverse axis of the putting subdivision 14 concurrently such that both the longitudinal contour and lateral contour of the putting surface can be concurrently or simultaneously changed.

Figure 9:
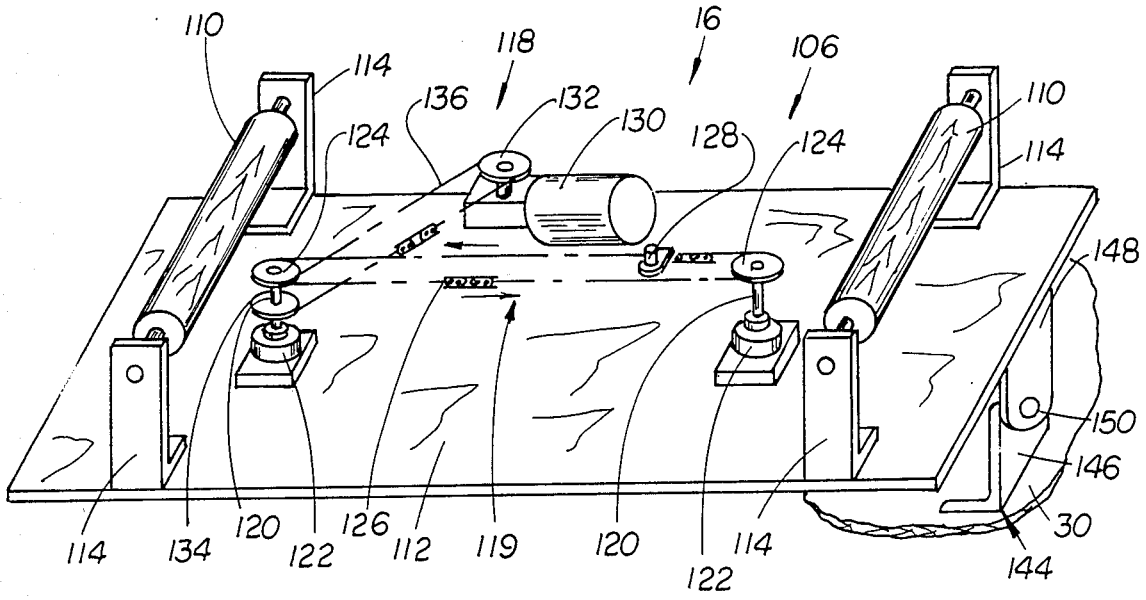
FIG. 9 is a perspective view, with portions broken away, showing details of the golf ball target area; and, FIG. 10 is a perspective view, with portions broken away, showing additional details of the golf ball target area.
Figure 10:
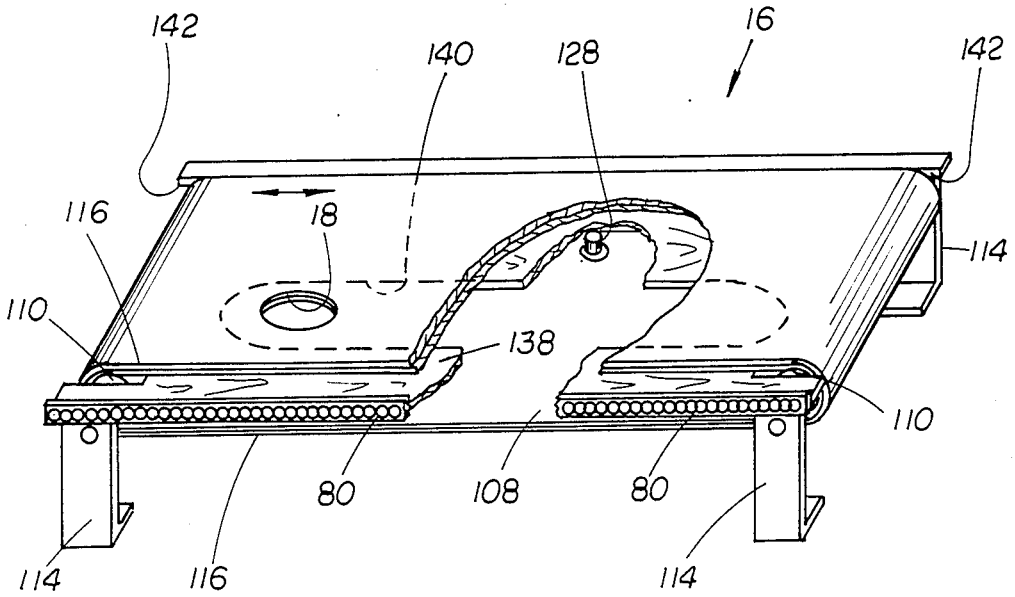

With reference to FIGS. 9 and 10, the target subdivision 16 includes golf ball target hole 18 moving means, generally denoted as the numeral 106, which includes an endless belt 108 trained about a pair of horizontal, spaced apart, parallel rollers 110. The rollers 110 are supported above a base 112 by means of brackets 114. The endless belt 108 is oriented for movement transverse to the longitudinal axis of the contourable surface of the putting subdivision 14 as indicated by the double headed arrows in FIG. 10. A length of fabric 116 covers the exterior surface of the endless belt 108. The fabric covering 116 can be of virtually any type, and is preferably the same as the fabric covering 77 over the putting subdivision 14. The single golf ball target hole 18 is defined by a hole formed through the top flight of the endless belt 108 and a like hole in the fabric 116 in mutual registration. As can be best seen in FIG. 9, the endless belt 108 is moved back and forth transversely to the contourable putting surface of the putting subdivision 14 by drive means, generally denoted as the numeral 118. The belt drive means 118 includes an endless chain mechanism 119 including two parallel, spaced apart vertical shafts 120 attached to the base 112 by journals 122. The endless chain mechanism 119 is located beneath the bottom flight of the endless belt 108, and the shafts 120 are spaced apart along the longitudinal axis of the endless belt 108. Chain drive sprockets 124 are attached to the shafts 120 and an endless driven chain 126 is trained about the sprockets 124 such that the chain flights are parallel to the longitudinal axis of the endless belt 108. A belt engagement spindle 128 is attached to one of the chain flights and extends vertically upwardly toward the bottom flight of the endless belt 108. The spindle 128 is off-set from the chain flight to which it is attached such that it lays on the longitudinal centerline between the two parallel chain flights of the endless driven chain 126. Therefore, as the endless driven chain 126 moves about the sprockets 124, as indicated by the arrows in FIG. 9, the spindle 128 moves back and forth between sprockets 124 along the longitudinal centerline between the chain flights. The belt drive means 118 further includes a driving motor 130, such as a fractional horsepower electric motor, mounted to the base 112 next to the endless chain mechanism 118. A driving sprocket 132 is attached to the output shaft of the motor 130, and a driven sprocket 134 is attached to one of the shafts 120 of the endless chain mechanism 118. A drive chain 136 is trained about the driving sprocket 132 and driven sprocket 134. Thus, as the motor 130 is energized the drive chain 136 moves as indicated by the arrows in FIG. 9 causing the endless driven chain 126 to also move about sprockets 124 as indicated by the arrows in FIG. 9.

Now with reference to FIG. 10, the lower flight of the endless belt 108 is formed with an appropriate aperture through which the vertical spindle 128 of the endless driven chain 126 is received. Therefore, as the spindle 128 moves back and forth between the sprockets 124, the endless belt 108 is caused to also move back and forth transversely of the longitudinal axis of the contourable putting surface of the putting subdivision 14 resulting in movement of the golf ball target hole 18 also transversely of the longitudinal axis of the contourable putting surface. A rectangular panel 138 is formed with an elongated slot 140 is positioned beneath the top flight of the endless belt 108 with the longitudinal axis of the elongated slot 140 in alignment with the center of the golf ball target hole 18 such that the golf ball target hole 18 remains in registration with the elongated slot 140 as the golf ball target hole 18 moves transversely. Clearance slits 142 at the opposite ends of the panel 138 provide for the passage of the endless belt 108. The golf ball target subdivision 16 is mounted for pivotal movement about an axis transverse to the longitudinal axis of the putting subdivision 14. Toward this objective, the golf ball target subdivision 16 is mounted to the frame structure floor 30 by pivot means, generally denoted as the numeral 144, oriented with the pivot axis transverse to the longitudinal axis of the putting surface of the putting subdivision. The pivot means 144 is illustrated as comprising two first pivot brackets 146 (only one being shown in FIG. 9) located beneath the target subdivision 16 and spaced apart from each other to either side of the longitudinal axis of the golf putting apparatus 10. The first pivot brackets 146 are affixed to the frame structure floor 30 and extend upwardly therefrom. The pivot means 144 further comprises two second pivot brackets 148 (only one being shown in FIG. 9) spaced apart from each other to either side of the longitudinal axis of the golf putting apparatus 10 by the same distance separating the first pivot brackets 146, affixed to the underside of base 112 of the target subdivision 16, and depending therefrom. Each of the first pivot brackets 146 is pivotally attached to the second pivot bracket 148 adjacent thereto by a pivot pin 150.

With reference to FIG. 10, the apertured rod anchor plate 80 is affixed to the transverse uprange edge of the panel 138 positioned beneath the top flight of the endless belt 108. The anchor plate 80 is positioned such that the rods 76 are substantially tangential with the top flight of the endless belt 108. Thusly, the covering 77 over the rods 76 of the putting subdivision 14 is substantially coplanar with the covering 116 over the endless belt 108.

All of the motors 54, 94, 96 and 130 can be controlled through appropriate circuitry (not shown) by manually operated switches conveniently located in the control panel (not shown) positioned next to the shooting subdivision 12 by a golfer standing on the shooting subdivision 12.

The foregoing detailed description is given primarily for clearness of understanding and no unnecessary limitations are to be understood therefrom for modifications will become obvious to those skilled in the art upon reading this disclosure and may be made without departing from the spirit of the invention or scope of the appended claims.

I claim:

1. A golf ball putting practice apparatus comprising:

a shooting area upon which a golfer stands when putting a golf ball;

a selectively contourable putting surface immediately downrange of the shooting area across which the golfer hits the golf ball and means for selectively inclining and declining the putting surface;

a target area formed with at least one golf ball target hole at the downrange end of the putting surface; and, means for selectively inclining and declining the shooting area relative to the putting surface without affecting the contour of the putting surface.

2. The golf ball putting practice apparatus of claim 1, wherein the shooting area is mounted for tilting movement about an axis transverse to the longitudinal axis of the putting surface at the interface of the shooting area and the putting

3. The golf ball putting practice apparatus of claim 1, wherein the means for selectively inclining and declining the putting surface is located beneath the shooting area.

4. The golf ball putting practice apparatus of claim 1, wherein the means for selectively inclining and declining the shooting area is controlled by a golfer standing on the shooting area.

5. The golf ball putting practice apparatus of claim 1, wherein the means for selectively inclining and declining the shooting area comprises jack means located beneath the shooting area.

6. The golf ball putting practice apparatus of claim 1, wherein the putting surface comprises means providing for changing the contour of the putting surface.

7. The golf ball putting practice apparatus of claim 6, wherein the means for selectively causing the contour of the putting surface to change its contour is located beneath the contourable putting surface.

8. The golf ball putting practice apparatus of claim 6, wherein the means providing for changing the putting surface contour comprises means for changing the contour generally transversely of the longitudinal axis of the putting surface.

9. The golf ball putting practice range apparatus of claim 6, wherein the means providing for changing the putting surface contour comprises means for changing the contour generally longitudinally of the putting surface.

10. A golf ball putting practice apparatus comprising:

means providing a pivotally mounted shooting area upon which a golfer stands when putting a golf ball;

a selectively contourable putting surface immediately downrange of the shooting area across which the golfer hits the golf ball;

means for selectively changing the contour of putting surface generally longitudinally of the putting surface;

a target area formed with at least one golf ball target hole at the downrange end of the putting surface; and, means pivotally mounting the entire target area for inclining and declining the target area relative to the putting surface in response to the changing longitudinal contour of the putting surface.

11. The golf ball putting practice apparatus of claim 10, wherein the target area is mounted for tilting movement about an axis transverse to the longitudinal axis of the putting surface.

12. The golf ball putting practicer apparatus of claim 10, wherein the target area further comprises:

(a) means defining the at least one golf ball target hole selectively movable in a straight line; and, (b) means for selectively repositioning the golf ball target hole along the straight line of movement thereof.

13. The golf ball putting practice apparatus of claim 12, wherein the means defining the at least one golf ball target hole is selectively movable transversely of the longitudinal axis of the putting surface.

14. A golf ball putting practice range apparatus comprising:

(a) a shooting area upon which a golfer stands when putting a golf ball;

(b) a target area downrange of the shooting area; and, (c) a contourable putting surface between the shooting area and target area across which the golfer hits the ball, comprising:

a plurality of parallel, flexible, resilient rods extending longitudinally of the putting surface from the shooting area to the target area and closely spaced across substantially the entire width of the contourable putting surface; and, for selectively bending the rods along their longitudinal axis.

15. The golf ball putting practice range apparatus of claim 14, wherein the uprange ends of the rods are attached to the shooting area, and the downrange ends of the rods are attached to the target area.

16. The golf ball putting practice range apparatus of claim 14, wherein the rod bending means provides for selectively bending different rods by a different amount.

17. The golf ball putting practice range apparatus of claim 14, wherein the rod bending means provides for selectively bending the rods upwardly and downwardly relative to the horizontal target.

18. The golf ball putting practice range apparatus of claim 14, wherein the rod bending means is located beneath the rods.

19. The golf ball putting practice range apparatus of claim 18, wherein the rod bending means comprises:

a plate located beneath the rods and in contact with the rods; and, means for mounting the plate for movement about the longitudinal axis of the putting surface and about the transverse axis of the putting surface.

20. The golf ball putting practice range apparatus of claim 19, wherein the rod bending means further comprises means for selectively moving the plate on the mounting means about the longitudinal axis of the putting surface, about the transverse axis of the putting surface, and concurrently about the longitudinal axis and transverse axis of the putting surface.

* * * * *